US009539468B2

(12) United States Patent
Nagasaka

(10) Patent No.: US 9,539,468 B2
(45) Date of Patent: Jan. 10, 2017

(54) PRONE WORKOUT ASSISTING INSTRUMENT

(76) Inventor: Toshimasa Nagasaka, Uji-shi (JP)

( * ) Notice: Subject to any disclaimer, the term of this patent is extended or adjusted under 35 U.S.C. 154(b) by 39 days.

(21) Appl. No.: 14/240,322

(22) PCT Filed: Aug. 20, 2012

(86) PCT No.: PCT/JP2012/071007

§ 371 (c)(1),
(2), (4) Date: Feb. 21, 2014

(87) PCT Pub. No.: WO2013/027703

PCT Pub. Date: Feb. 28, 2013

(65) Prior Publication Data

US 2014/0206511 A1 Jul. 24, 2014

(30) Foreign Application Priority Data

Aug. 23, 2011 (JP) ..... 2011-181351

(51) Int. Cl.
*A63B 71/00* (2006.01)
*A63B 26/00* (2006.01)
(Continued)

(52) U.S. Cl.
CPC ..... *A63B 26/00* (2013.01); *A63B 21/4037* (2015.10); *A63B 22/16* (2013.01); *A63B 23/0216* (2013.01); *A63B 2208/0252* (2013.01)

(58) Field of Classification Search
CPC . A63B 26/00; A63B 23/0205; A63B 23/0216; A63B 23/0211; A63B 23/0222; A63B 23/0227; A63B 23/0233; A63B 23/0238; A63B 21/1473; A63B 21/1476; A63B 22/16; A63B 2208/0252; A63B 2208/0257
See application file for complete search history.

(56) References Cited

U.S. PATENT DOCUMENTS 3,967,820 A * 7/1976 Harper ..... A63B 22/16 280/12.1
5,611,765 A * 3/1997 Koch, Jr. ..... 482/142
(Continued)

FOREIGN PATENT DOCUMENTS

JP 6368344 U 5/1988
JP 09135921 A 5/1997
(Continued)

OTHER PUBLICATIONS

ISA Japanese Patent Office, International Search Report of PCT/JP2012/071007, Sep. 18, 2012, WIPO, 4 pages.
(Continued)

*Primary Examiner* — Loan H Thanh
*Assistant Examiner* — Megan Anderson
(74) *Attorney, Agent, or Firm* — Alleman Hall McCoy Russell & Tuttle LLP

(57) ABSTRACT

An assisting instrument allows a person to effectively train their core muscles by movements in twisting directions or one leg raises, and allows the twisting movements to be made in a prone posture. A first body part is comprised of a rectangular parallelepiped part and an integrated semicircle pillar section. When the assisting instrument is used during workouts in the prone posture, the person's two anterior superior iliac spines and pubis part are protected by a first pad, a second pad, and a third pad, respectively, and their abdomen is fitted into a groove part. When the person raises one of their legs, the semicircle pillar section rolls to the opposite side. As a result of holding their body to prevent the rolling and prevent their body from being thrown out of the instrument, the person puts their strength in their core muscles which can thus be trained.

2 Claims, 7 Drawing Sheets

(51) Int. Cl.
*A63B 22/16* (2006.01)
*A63B 23/02* (2006.01)

(56) References Cited

U.S. PATENT DOCUMENTS 5,702,333 A * 12/1997 Waldron ..... A63B 23/0233 482/131
5,752,067 A * 5/1998 Wilkinson ..... G06F 7/483 712/16
5,772,686 A * 6/1998 Caruana ..... A63B 23/03575 5/633
6,324,710 B1 * 12/2001 Hernandez et al. ..... 5/630
7,537,555 B2 * 5/2009 Soletski ..... A63B 22/16 482/142
8,376,920 B2 * 2/2013 Anderson ..... 482/140
8,632,443 B2 * 1/2014 Hauptmann ..... 482/130
2011/0207587 A1 * 8/2011 De La Rambelje ..... 482/140
2012/0214653 A1 * 8/2012 Tsou ..... A63B 21/00047 482/142
2013/0029815 A1 * 1/2013 Lu ..... A63B 21/0004 482/142
2013/0053228 A1 * 2/2013 Winegar ..... A63B 22/16 482/146

FOREIGN PATENT DOCUMENTS

JP 2000210365 A 8/2000
JP 2003225326 A 8/2003
JP 3102644 U 4/2004
JP 2005137567 A 6/2005
JP 2009530044 A 8/2009
JP 3166427 U 2/2011
WO 2007112117 A2 10/2007

OTHER PUBLICATIONS

"What is StrechPole Active?", Conditioning Center Being, Jul. 30, 2009, Retrieved at http://be-ing.net/active/, 4 pages (See Specification, submitted Feb. 21, 2014, for explanation of relevance).

* cited by examiner

PRONE WORKOUT ASSISTING INSTRUMENT

TECHNICAL FIELD

The present invention relates to an instrument for supporting workouts in a prone posture.

BACKGROUND ART

FIG. 7 is a perspective view schematically illustrating a conventional workout assisting instrument 100, publicly available under the brand name "StretchPole Active®," which is used in a prone posture. The workout assisting instrument 100 is entirely formed by a rubber member made of an elastic material. When a person works out, since a surface of a planar part of the instrument 100 is in full contact with a floor surface, the instrument 100 enables the person to work out in the prone posture in a three-point supporting state, while maintaining an immobile state. That is, a first part 100PA projected from a central part of the instrument 100 contacts a pubis part of the body of the person working out in the prone posture. Further, a second part 100PB extending in an upper right direction at an angle of about 45° from the first part 100PA contacts a protruding part (left anterior superior iliac spine) of a left pelvis part of the person's body. Further, a third part 100PC extending in an upper left direction at an angle of about 45° from the first part 100PA contacts a protruding part (right anterior superior iliac spine) of a right pelvis part of the person's body. By the three-point contact between the parts and the person's body, the workout assisting instrument 100 supports the person's body in the prone posture at the three points. The workout assisting instrument 100 has an advantage as a product in that it is always in a fixed state and immobile during workouts, when the person working out performs the various movements of the workouts while the surface of the planar part of the instrument is in full contact with the floor surface, as described above. The person working out can mainly strengthen their running ability by performing an exercise of raising their limbs in the prone posture with the three-point support as described above.

REFERENCE DOCUMENTS OF CONVENTIONAL ART

Patent Documents

Patent Document 1: JP3166427U
Patent Document 2: JP2009-530044A (FIG. 42; [0187])
Patent Document 3: JP3102644U
Patent Document 4: JP09-135921A
Patent Document 5: JP2005-137567A

Nonpatent Document

Non Patent Document 1:
"*What is StretchPole Active*?" [online], Conditioning Center Being, Jul. 30, 2009, [searched in October 19, Heisei 23 (2011)], Internet <URL:http://be-ing.net/active/>

DISCLOSURE OF THE INVENTION

Problem(s) to be Solved by the Invention

Since the workout assisting instrument 100 of FIG. 7 is always fixed and in an immobile state while the person is working out in the prone posture, another problem is created that the person cannot easily perform twisting movements of their body to the left and the right because their pelvis is fixed while their arms and legs are restricted in movement. Further, when using the workout assisting instrument 100, it is not only difficult to exercise the pelvis of the hips, but the range of one-leg raising exercises or one-arm raising exercises also becomes narrow. Therefore, a problem is caused for the person that their exercises become stilted and difficult.

In addition, during the workouts in the prone posture using the workout assisting instrument 100, pain is caused in the left and the right protruding parts (left and right anterior superior iliac spines) of the pelvis, and since this pain will not be absorbed, this causes a problem that the pain will not be eased during the workouts. In addition, during the workouts in the prone posture, the fixed state of the workout assisting instrument 100 due to the full-contact with the floor surface continues. For this reason, since a state where pressure concentrates on the pubis part continues, relatively stronger pain is caused in the pubis part as compared with the pain in the protruding parts of the pelvis. Therefore, this also causes a problem that the uncomfortable feeling continues to occur in the pubis part.

The present invention is primarily for overcoming the two problems described above and is made for generating twisting movements centering on the pelvis which was impossible with the workout assisting instrument 100. The main purpose of the present invention is directed toward obtaining an instrument for supporting workouts in a prone posture and which is capable of maintaining a destabilized state at all times during a person's workout.

SUMMARY OF THE INVENTION

A prone workout assisting instrument according to the subject matter of the present invention includes a first body part including (A) a rectangular parallelepiped part extending in a first direction parallel to a floor surface and being a first fulcrum of a pubis of a person during workouts in a prone posture, and (B) a supporting part entirely integrated with a bottom part of the rectangular parallelepiped part in the first direction, and including an apex part that comes in a contact state of linear contact in the first direction with the floor surface when the person works out in the prone posture; a second body part projected from a first part of one side surface part extending in the first direction of the rectangular parallelepiped part of the first body part in a second direction along a surface parallel to the floor surface through which the first direction passes, said first part corresponding to one end side part of said one side surface part and being between one part corresponding to a head-side part of the person during the workouts in the prone posture and the other part separated from the one part by a predetermined dimension within said rectangular parallelepiped part; a third body part projected from a second part of the other side surface part extending in the first direction and opposing to the one side surface part of the rectangular parallelepiped part of the first body part in a third direction that extends away from the second body part and along the surface parallel to the floor surface, said second part corresponding to the one end side part of the other side surface part and being between one part corresponding to the head-side part of the person during the workouts in the prone posture and the other part separated from the one part for the predetermined dimension within said rectangular parallelepiped part; a first cushioning part of an elastic body integrated with the second body part and being a second fulcrum of a right anterior superior iliac spine of an ilium of the person during the workouts in the prone posture; and a second cushioning part of an elastic body integrated with the third body part and being a third fulcrum of a left anterior superior iliac spine of the ilium of the person during the workouts in the prone posture.

Effects of the Invention

According to the subject matter of the present invention, when the person works out in the prone posture using the assisting instrument, both the left and right protruding parts of the hip parts of the person's pelvis (that is, the left and right anterior superior iliac spine parts of the ilium of the pelvis) contact the first cushioning part and the second cushioning part of the elastic bodies and are supported by the cushioning parts, respectively, and the pubis of the person's pelvis is supported by the rectangular parallelepiped part. Further, the apex part of the supporting part of the first body part is in a state of linear contact with the floor surface, inclines to the left and the right, and supports the rotational movements (the twisting movements to the left and the right), while the supporting part maintains the contact state with the floor surface according to the rotation of the hips. The lower half of the person's body below their hips, i.e., the person's pelvis, is supported by fulcrums at three points of contact: at two points between each of both the cushioning parts and the corresponding side of the anterior superior iliac spines of the ilium of the pelvis, respectively, and at one point between the upper surface of the rectangular parallelepiped part of the first body part and the pubis of the pelvis. In addition, the first body part is supported by the floor surface in the state of linear contact between the apex part of the supporting part (for example, the semicircle pillar section) and the floor surface. When the person performs a workout of twisting their hips in various ways in the prone posture with the three-point support of the pelvis, since their pelvis is stabilized by the three-point support as described above, the person is able to more easily rotate their hips more intensively, and is thus able to more easily train their back. In that case, since the force applied to each of the left and right anterior superior iliac spine parts of their pelvis or each of the left and right protruding parts of their hips is absorbed by the second cushioning part and the first cushioning part, respectively, pain in the left and right anterior superior iliac spine parts of the pelvis or the protruding parts of the hips is absorbed by the respective cushioning parts, and is reduced remarkably.

Meanwhile, according to the subject matter of the present invention, when the person moves one arm up and down greatly to train their back, or when the person moves one leg up and down greatly to train their back and their leg, the assisting instrument tends to shift from a stable state to an unstable state, contrary to the conventional instrument. This is also the same for movements of the person's torso. That is to say, due to the up-and-down movements of the leg or the like, the apex part of the supporting part, which is comprised of, for example, the semicircle pillar part, greatly inclines either to the left or the right and it becomes impossible to maintain the state of linear contact with the floor surface. Then, since the supporting part begins to roll in the inclined direction, the person will be thrown out of the assisting instrument if they stay in the same posture. In order to resolve this unstable state and to try to continue the workout, the person must put their strength into their core muscles which are the muscles deep inside their abdomen (a muscle group which is comprised of a diaphragm, a pelvic bottom muscle group, a transverse abdominal muscle, and a multifidus muscle, and which exists inside a deep part from the pelvis to the abdominal cavity) and use the exertion of their abdominal muscles to prevent the rolling of the supporting part. Therefore, by conversely taking advantage of the unstable state of the assisting instrument with the supporting part which tends to roll, the person becomes able to more easily train the core muscles of their abdomen which are generally hard to train. To be precise, by rejecting the fixed idea that workouts in the prone posture should be performed in a stable state, the person can train their core muscles with the utilization of the assisting instrument which is created by reverse thinking Moreover, according to the subject matter of the present invention, by the absorbing function of the third cushioning part that extends in the first direction, which is placed on the upper surface of the other end part of the rectangular parallelepiped part on the person's leg side and forms the first fulcrum of the pubis of the ilium, pain caused in the pubis part by the pressing force of the person's body can be reduced remarkably, as compared with the conventional product.

Hereinafter, various embodiments of the present invention will be described in detail, along with their effects and advantages based on the accompanying drawings.

MODES FOR CARRYING OUT THE INVENTION

Embodiment 1

Configuration of Prone Workout Assisting Instrument

Figure 1:
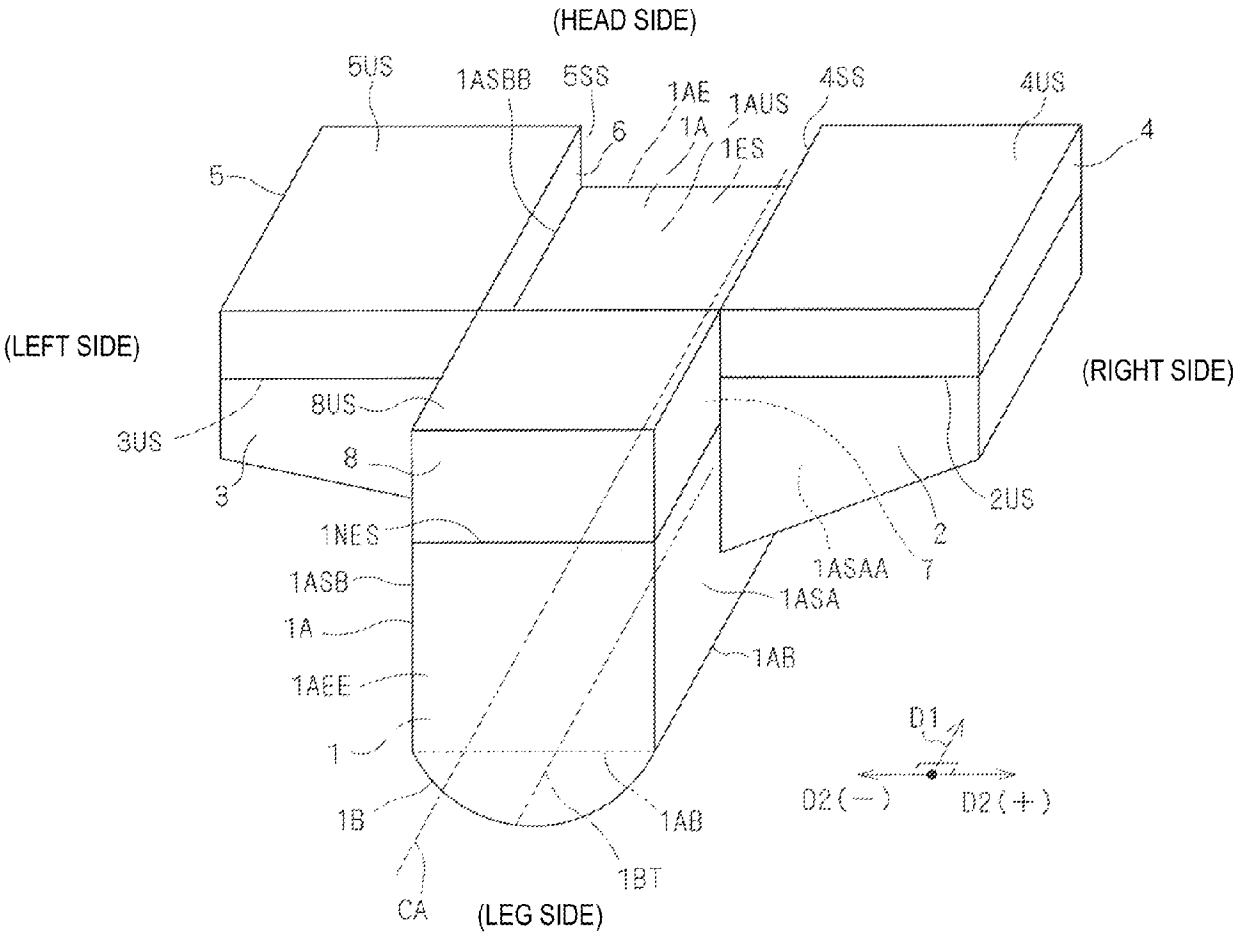
FIG. 1 is a perspective view according to Embodiment 1 of the invention illustrating a configuration of a prone workout assisting instrument.
Figure 2:
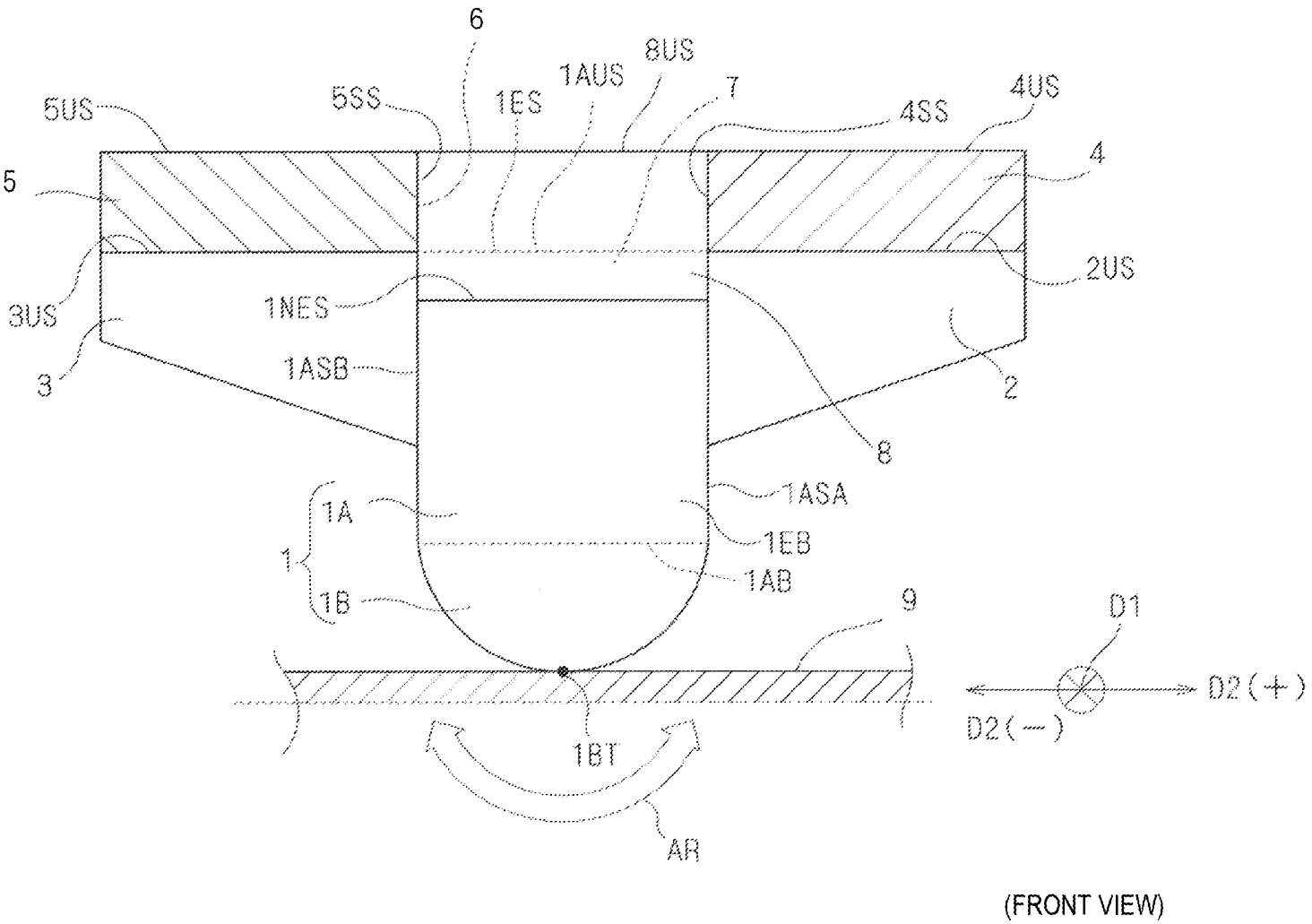
FIG. 2 is a front view according to Embodiment 1 of the invention illustrating the configuration of the prone workout assisting instrument.
Figure 3:
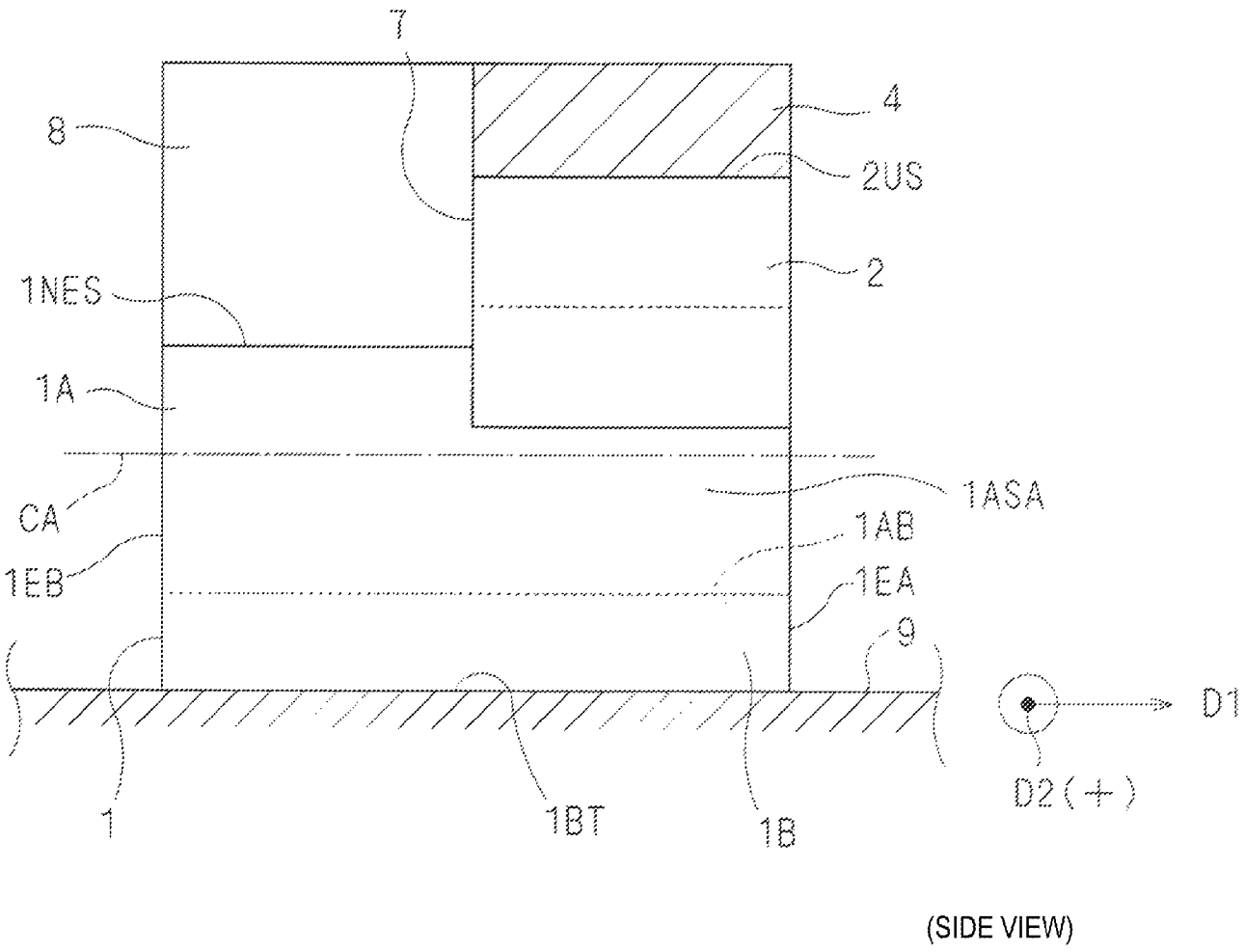
FIG. 3 is a side view according to Embodiment 1 of the invention illustrating the configuration of the prone workout assisting instrument.
Figure 4:
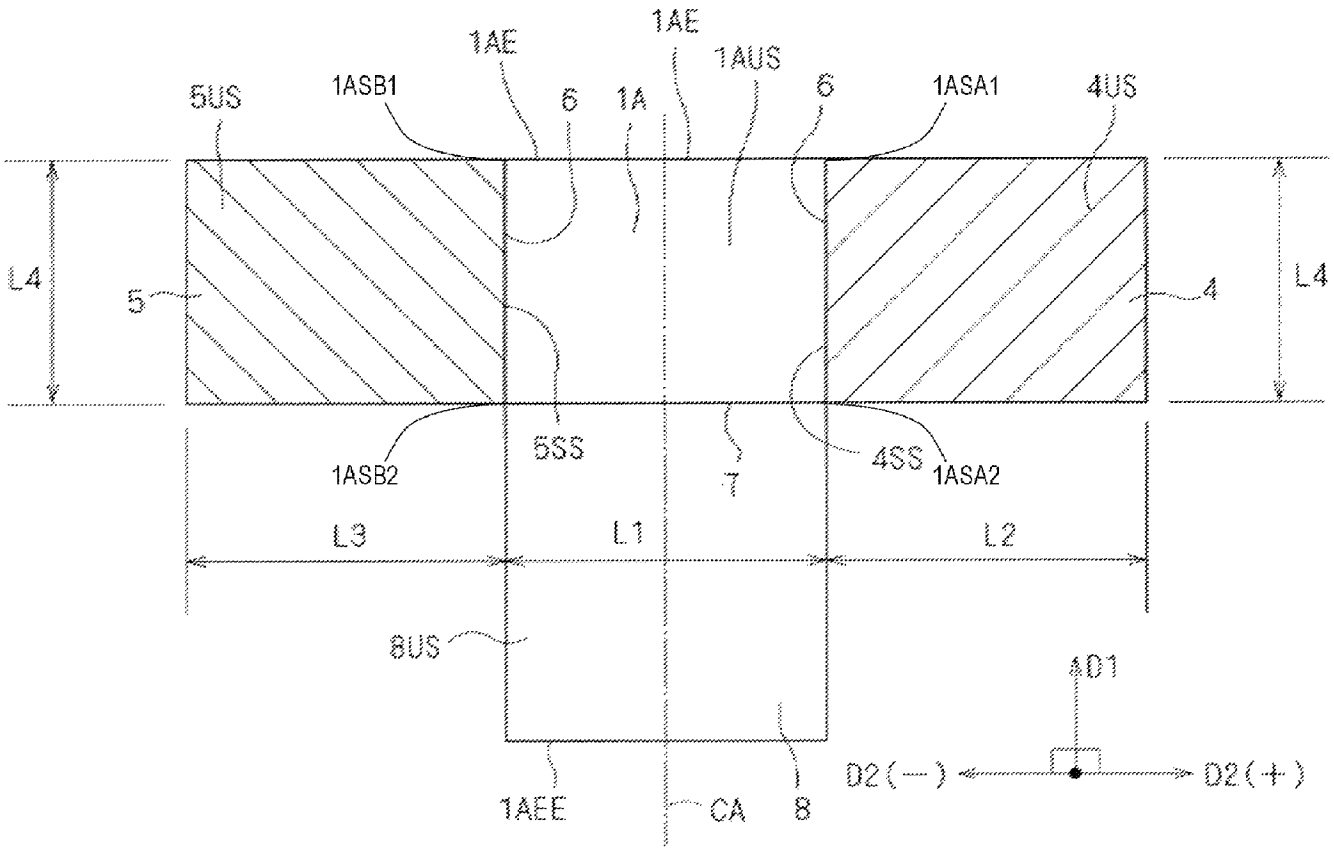
FIG. 4 is a top view according to Embodiment 1 of the invention illustrating the configuration of the prone workout assisting instrument.

FIG. 1 is a perspective view schematically illustrating a configuration of a prone workout assisting instrument (hereinafter, referred to as "the assisting instrument") according to this embodiment. FIG. 2 corresponds to a front view of FIG. 1, when viewing the assisting instrument straightforward from a legs side of a person when the assisting instrument is arranged to be stationary on a floor surface 9. FIG. 3 is a side view when viewing the assisting instrument of FIG. 1 from the right side. FIG. 4 is a top view when viewing the assisting instrument of FIG. 1 from straight above.

Note that although hatching is drawn in each of pads 4 and 5 described later in FIGS. 2, 3, and 4, this hatching is not illustrative of cross sections because the hatching is illustrated to facilitate understanding of the structure.

As illustrated in these drawings, a center axis CA of a first body part 1 extends in a first direction D1 parallel to a floor surface 9. The first body part 1 includes (A) a rectangular parallelepiped section 1A which extends in the first direction D1, and (B) a semicircle pillar section 1B of which the vertical cross-sectional shape perpendicular to the first direction D1 is a semicircle. Here, the semicircle pillar section 1B is entirely integrated with a bottom portion 1AB of the rectangular parallelepiped section 1A in the first direction D1. For example, in the case of the assisting instrument illustrated in FIG. 1, the rectangular parallelepiped section 1A and the semicircle pillar section 1B are fabricated so as to be completely integrated together into one member. In this case, the bottom portion 1AB of the rectangular parallelepiped section 1A drawn with a dashed line is a part which is to be recognized abstractly for the convenience of description. However, the first body part 1 may be constructed after independently fabricating the rectangular parallelepiped section 1A and the semicircle pillar section 1B by stacking and pasting both the sections 1A and 1B together (this state is also called "integration"). Then, when a person (hereinafter, referred to as "the person working out") works out in a prone posture and in a state where their pelvis is supported at three points by the assisting instrument as described later, an apex part 1BT of the semicircle pillar section 1B of the assisting instrument linearly contacts with the floor surface 9 in the first direction D1 in a stationary state. The first body part 1 is made of, for example, plastic. Note that the apex part 1BT of the semicircle pillar section 1B corresponds to a semicircle middle part.

Moreover, a second body part 2 projects from a first portion 1ASAA of one side surface section 1ASA of the rectangular parallelepiped part 1A of the first body part 1, perpendicular to the first direction D1 and to a rightward direction D2(+) of the second directions D2(−) and D2(+) parallel to the floor surface 9. Note that in this embodiment, although the second body part 2 has an inclined bottom portion, this is merely an example and the shape of the part 2 is not limited to this shape. The same can also be said for the shape of a third body part 3 described later. Here, the first portion 1ASAA of the one side surface section 1ASA of the rectangular parallelepiped section 1A corresponds to a part which is from one part 1ASA1 of the one side surface section 1ASA to another part 1ASA2 separated from the one part 1ASA1 by a predetermined dimension L4 (refer to FIG. 4) in the first direction D1. In addition, the one part 1ASA1 of the one side surface section 1ASA corresponds to, during the workouts in the prone posture, a part of the first body part 1 or the rectangular parallelepiped section 1A, closer to one end portion 1AE located on the head side of the person working out. A first pad 4 is entirely placed on an upper surface 2US of the second body part 2. Of course, the first pad 4 may be partially placed on the upper surface 2US in the second directions D2, as long as a side surface 4SS having the length of the predetermined dimension L4 in the first direction is obtained. This first pad (corresponding to a first cushioning part) 4 is comprised of an elastic body (for example, urethane or rubber) which can absorb a pressing force applied to the pad 4 by a right ilium of the pelvis of the working out.

Further, the third body part 3 projects in the second direction D2 away from the second body part 2, from a second portion 1ASBB of the other side surface section 1ASB of the rectangular parallelepiped part 1A of the first body part 1, opposite from the one side surface section 1ASA in the second direction D2, the other side surface section 1ASB extending in the first direction D1. Here, the second portion 1ASBB of the other side surface section 1ASB corresponds to a part from one part 1ASB1 of the first body part 1 or the rectangular parallelepiped section 1A corresponding to the one end side portion 1AE located on the head side of the person working out (when working out in the prone posture) to another part 1ASB2 separated from the one part 1ASB1 in the first direction D1 by the predetermined dimension L4 (refer to FIG. 4). A second pad (corresponding to a second cushioning part) 5 is entirely placed on an upper surface 3US of the third body part 3. Of course, the second pad 5 may be partially placed in the second directions D2 on the upper surface 3US, as long as a side surface 5SS having the length of the predetermined dimension L4 in the first direction is obtained. This second pad 5 is also comprised of an elastic body (for example, urethane or rubber) which can absorb a pressing force applied to the second pad 5, similar to the first pad 4.

It should be particularly noted that a groove part 6 is formed between the opposing side surfaces 4SS and 5SS of both the pads 4 and 5. That is, the groove part 6 is comprised of the side surface 4SS of the first pad 4 opposing to the second pad 5, the side surface 5SS of the second pad 5 opposing to the first pad 4, an exposed part 1ES of an upper surface TAUS of the rectangular parallelepiped section 1A of the first body part 1 between the side surface 4SS of the first pad 4, and the side surface 5SS of the second pad 5. The implication of the existence of the groove part 6 will be further clarified in a later description of a method of using the assisting instrument. Roughly, the groove part 6 has an advantage such that, during the workouts in the prone posture, the groove part 6 is a part into which the abdomen of the person whose pelvis is supported at three points by the assisting instrument fits, and the tightening of the person's core muscles can be facilitated according to the fitted state of the abdomen.

Note that reference symbols 1EA and 1EB illustrated in FIG. 3 are one end part (head-side part) and the other end part (leg-side part) of the first body part 1 in the first direction D1, respectively. Further, reference symbols 1AE and 1AEE illustrated in FIG. 1 are one end part (head-side part) and the other end part (leg-side part) of the rectangular parallelepiped section 1A in the first direction D1, respectively.

As illustrated in FIGS. 2 and 3, the rectangular parallelepiped section 1A of the first body part 1 is provided with a stepped part 7. This stepped part 7 is a part of the upper surface 1AUS of the rectangular parallelepiped section 1A and positions a part 1NES other than the exposed part 1ES to be at a position lower than the position of the exposed part 1ES. Further, a third pad (corresponding to a third cushioning part) 8 comprised of an elastic body (made of rubber, urethane or the like) which can absorb a pressing force applied to the pubis during the workouts in the prone posture is, as an example of this embodiment, placed over the entire part 1NES of the upper surface TAUS of the rectangular parallelepiped section 1A other than the exposed part 1ES.

Note that although a dimensional relation of lengths L1, L2, and L3 illustrated in FIG. 4 is set as L1=L2=L3 in this embodiment, different dimensional settings from the dimensional relation may also be possible, of course.

Further, the rectangular parallelepiped part 1A of the first body part 1, the second body part 2, and the third body part 3 which are illustrated in FIG. 1 may be made of a metal with relatively high elastic deformation when compared with gold or the like (such as aluminum, for example), respectively. In this case, the third pad 8, the first pad 4, and the second pad 5 are placed on the upper surfaces 1AUS, 2US, and 3US of the rectangular parallelepiped section 1A, the second body part 2, and the third body part 3 made of metal, respectively. Here, a coupled state between the second body part 2 made of metal and the first pad 4 constituting "the first cushioning part" is also defined as "the integrated state of the components 2 and 4." Further, a coupled state between the third body part 3 made of metal and the second pad 5 constituting "the second cushioning part" is also defined as "the integrated state of the components 3 and 5."

<Use of Prone Workout Assisting Instrument>

Below, the workouts in the prone posture using the assisting instrument will be described, suitably referring to FIGS. 1 to 4.

First, as illustrated in FIG. 2, the person working out places the assisting instrument having the structure of FIG. 1 on the floor surface 9 such that the entire apex part 1BT of the semicircle pillar section 1B linearly contacts with the floor surface 9. In this case, the one end part 1EA (FIG. 3) of the first body part 1 is oriented on the head side of the person working out, and the other end part 1EB (FIG. 3) of the first body part 1 is oriented on the leg side of the person working out.

In this state, the person working out lies with their body in the prone posture. The person working out brings a front surface part of their right hip part, i.e., the right anterior superior iliac spine part of the ilium of the pelvis, to be in surface contact with the upper surface 4US of the first pad 4, while maintaining the prone posture. Similarly, the person working out brings a front surface part of their left hip part, i.e., the left anterior superior iliac spine part of the ilium of the pelvis, to be in contact with the upper surface 5US of the second pad 5. Further, the person working out moves the lower half of their body until the pubis part of the pelvis touches the upper surface 8US of the third pad 8. In this case, the person working out is in a state of supporting their own weight by their forearm parts (below both the elbow joints), their lower leg parts (below both the knee joints), and the assisting instrument.

Then, in this state, the pelvis of the person working out and their body parts near the pelvis are supported at two points by the assisting instrument via a third fulcrum and a second fulcrum due to the surface contact between the left and the right front surfaces of the hip parts of the person's body with the second pad 5 and the first pad 4, respectively. In addition, the front surface of the pubis part of the pelvis of the body of the person working out is also supported at the first fulcrum by the surface contact between the front surface and the third pad 8 of the assisting instrument. As a result, the pelvis of the body of the person working out is supported at the three points by the assisting instrument.

In addition, the entire apex part 1BT of the semicircle pillar section 1B of the assisting instrument is in a state of linear contact with the floor surface 9 in the first direction D1 (see FIGS. 2 and 3). For this reason, when the body of the person working out is in the prone posture for the workouts, the assisting instrument is in an unstable state where the instrument easily rocks in the left and right directions AR (refer to FIG. 2). This "unstable state" in the left and right directions AR is a major feature of the assisting instrument together with the three-point support of the pelvis described above, and such an unstable state is intentionally created by the assisting instrument.

Thus, in this three-point supporting state, the abdomen part of the person working out is fitted into the groove part 6 of the assisting instrument as a natural result of the person's body lying prone. The fitting of the abdomen, as well as the first and second pads 4 and 5 being placed for the two-point support, is also a feature associated with the unstable state of the assisting instrument when using the assisting instrument previously described.

Figure 7:
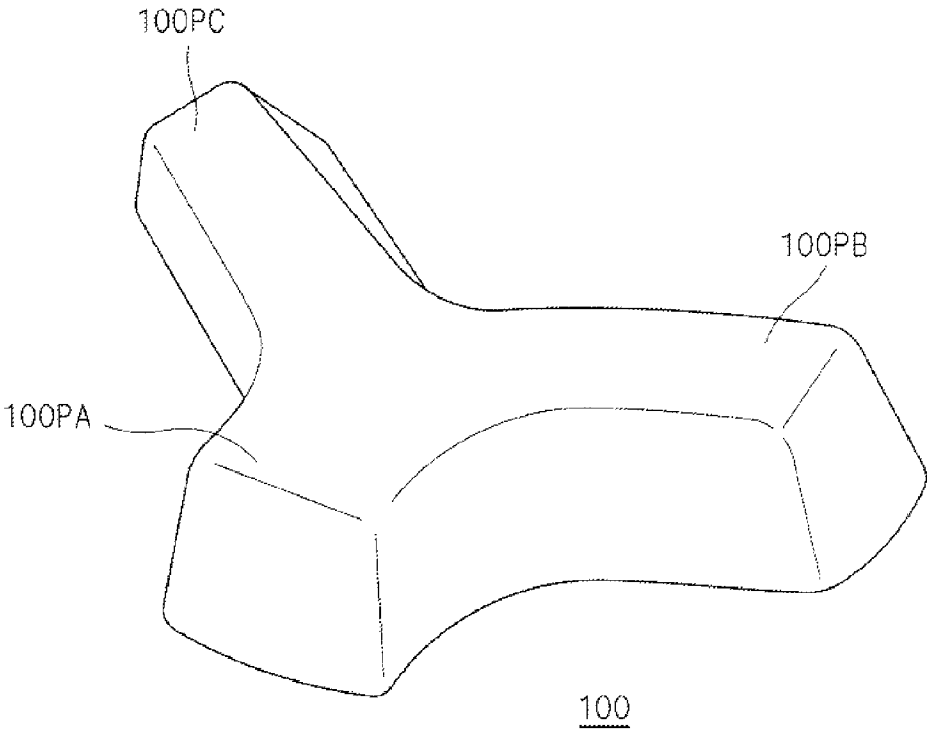
FIG. 7 PRIOR ART
FIG. 7 is a perspective view according to conventional technology schematically illustrating a configuration of a prone workout assisting instrument.

(1) In such a posture, the person working out can freely rock their hip parts in the left and right directions AR centering on his/her pelvis with a greater movement than the conventional product (refer to FIG. 7). In this case, in the stationary state, the support of the assisting instrument on the floor surface 9 is obtained by the state of linear contact between the apex part 1BT of the semicircle pillar section 1B and the floor surface 9. Then, according to the movement of the hip parts shaking to the left and the right centering on the pelvis of the person working out described above, the semicircle pillar section 1B can move in the left and right directions AR (refer to FIG. 2), while the state of linear contact between the floor surface 9, and the apex part 1BT of the semicircle pillar section 1B and left and right semicircular surfaces near the apex part 1BT, is maintained in the unstable state. Therefore, the person working out can perform various kinds of workouts with the twisting movement (rotating direction) of the hip parts centering on their pelvis and, thus, the strength in their back can be increased, according to their intention. In this regard, the conventional product (FIG. 7), which is immobile in the left and right directions during workouts since a surface of the flat part of the product is in full contact with the floor surface, cannot obtain this feature. This feature can be obtained for the first time by the assisting instrument that supports the pelvis of the person's body at three points while the person lies prone in the unstable state, that is, by the mobility of the assisting instrument to move freely in the left and right directions AR, while the apex part 1BT of the semicircle pillar section 1B and the left and right semicircular surfaces near the apex part 1BT unstably maintain the state of linear contact in the first direction D1 with the floor surface 9.

Figure 5:
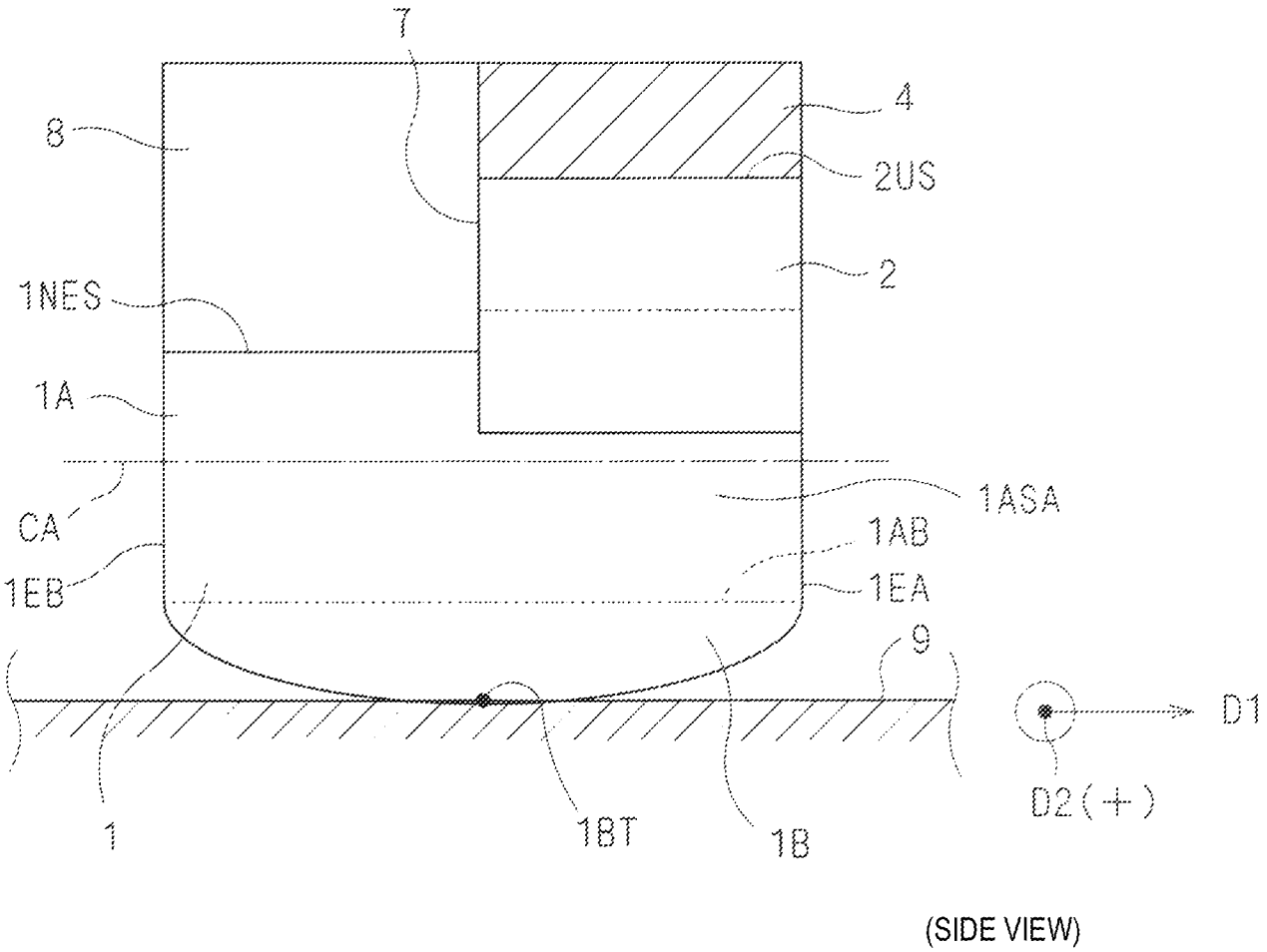
FIG. 5 is a side view according to a modification of Embodiment 1 of the invention illustrating a configuration of a prone workout assisting instrument.

In addition, during the workouts of the hip parts rocking freely to the left and the right centering on the pelvis, the person working out can concentrate on the workouts without feeling totally uncomfortable. That is, 1) since the right protruding part of the hip part of the pelvis (right iliac ridge part of the ilium) is in contact with the upper surface 4US of the first pad 4, the pressing force applied to the right protruding part of the hip part is absorbed by the first pad 4. As a result, the pain in the right protruding part of the hip part which the person working out feels during the workouts in the prone posture is remarkably reduced by the first pad 4 compared with the conventional product (refer to FIG. 7) simply made of rubber. 2) Similarly, since the left protruding part of the hip part of the pelvis (the left ridge part of the ilium) is in contact with the upper surface 5US of the second pad 5, the pressing force applied to the left protruding part of the hip part is also effectively absorbed by the second pad 5, and the pain in the left protruding part of the hip part during the workouts is also reduced remarkably by the second pad 5, as compared with the conventional product. 3) In addition, the maximum pain caused in the pubis during use of the conventional product can be remarkably reduced (refer to FIG. 5). That is, during the workouts in the prone posture, since the pubis part of the pelvis is always in contact with the upper surface 8US of the third pad 8 of the assisting instrument, the pressing force applied to the pubis part during the workouts is certainly absorbed by the third pad 8, regardless of the person's gender. Therefore, the instrument can remarkably reduce the pain caused in the pubis part. Therefore, the person working out can perform their intended exercises, concentrating on the twisting movements in the left and right directions AR described above almost without being conscious of the uncomfortable feelings associated with pain felt in the pubis part in the conventional product (refer to FIG. 7) during the workouts in the prone posture.

(2) Moreover, the second effect of the workouts in the prone posture using the assisting instrument is being able to directly and effectively train the core muscles which are located directly inside the abdomen, which is very difficult to train for example, by usual workouts such as sit-ups. The effect of the ability to directly train the core muscles is based on the structure which intentionally enables the generation of the unstable state in the left and right directions AR (referring to FIG. 2) about the semicircle pillar section 1B extending in the first direction D1 of the assisting instrument upon the workouts in a state where the person's body is supported at the three points in the prone posture. The structural features of the assisting instrument are based on the reverse thinking which eliminated the fixed idea or the approach of always maintaining an instrument in a fixed state during the workouts in the prone posture. The following is about a method of using the assisting instrument in order to describe in detail the intentional implementation of the unstable state in the left and right directions AR of the assisting instrument during the workouts in the prone posture of the person's body and the three-point supporting state of their pelvis.

For example, when the person working out trains their back by greatly raising their right arm, since the center of gravity of their body moves to the left, the left hip part of their body (the left part of their ilium) substantially rests the weight on the upper surface 5US side of the second pad 5. Therefore, the assisting instrument inclines greatly to the left, and it becomes impossible to support the first body part 1 with the fulcrum of the state of linear contact between the apex part 1BT of the semicircle pillar section 1B and the floor surface 9. As a result, the fulcrum of the semicircle pillar section 1B and the floor surface 9 moves greatly to the left, and the semicircle pillar section 1B begins to roll to the left. Similarly, also when the person working out trains their back by greatly raising their right leg and bending their body backward, as a result of the center of gravity of their body moving to the left from the central part, the assisting instrument inclines greatly to the left, and it becomes impossible to support the first body part 1 with the fulcrum of the state of linear contact between the apex part 1BT of the semicircle pillar section 1B and the floor surface 9. As a result, the semicircle pillar section 1B begins to roll to the left. The person working out will be thrown out of the assisting instrument to the left due to the rolling movement of the semicircle pillar section 1B to the left. The rolling movement of the semicircle pillar section 1B resulting from the unstable state of the first body part 1 is also similarly caused when the person greatly raises their opposite arm or their opposite leg, or when the person moves their torso. Note that for the movement of their opposite arm or the like, the rolling movement of the semicircle pillar section 1B is caused to the right, and the person working out is thrown out of the assisting instrument to the right.

Therefore, the person working out whose pelvis is supported in the prone posture by the assisting instrument at the three points is going to continue the workouts for training their back while preventing their body from being thrown to either left or right. To make this happen, the person working out puts their strength in the core muscles of their abdomen, which is fitted and fixed into the groove part 6, to stop the rolling movement of the semicircle pillar section 1B, which is about to roll, and maintain the original state by maintaining the state of linear contact between the apex part 1BT of the semicircle pillar section 1B and the floor surface 9. When the person working out performs the leg raise to train their back or the like, the person can also train their core muscles simultaneously by maintaining the movement of putting the force into their core muscles in the prone posture. This effect can be said to be the greatest advantage of the assisting instrument which can be obtained by intentionally destabilizing the assisting instrument, which is supporting the pelvis of the person's body in the prone posture at the three points, to the left and the right in the first direction D1.

<Conclusion on Structural Features of Assisting Instrument>

The structural features of the assisting instrument can be summarized into the following three points:

1) three-point support of the anterior superior iliac spines and the pubis;

2) the supporting part (for example, the semicircle pillar part) of the first body part is unstable in the left and right directions (in the left and right directions: unstableness=mobility); and 3) the first to third cushioning parts (for example, comprised of pads) are clearly provided.

<The Implication of the Existence of Feature #1 Described Above>

The structural stability of the pelvis can be brought out. The three-point support in this posture brings out a nodding movement of the sacrum. This brings out the structural stability of the pelvis. This efficacy brings out load transferability of the pelvis to cause an increase in performance of sports (such as golf or tennis) which transmits the force of the legs to the hands during work outs in a standing posture.

<The Implication of the Existence of Feature #2 Described Above> i) The supporting part of the semicircle pillar part and the like creates the unstable state of the assisting instrument to the left and the right to take advantage of the reaction when the person's body tries to stabilize the assisting instrument from the unstable state.

ii) The distortion of the person's body or their eccentric ways of moving their body becomes apparent (e.g., in a case where the person working out can raise their right leg, the person will roll and fall if they raise their left leg).

iii) A new exercise can be created. That is, an exercise which was impossible with the conventional product can be created. The new exercise is rotating the person's body to the left and the right, while maintaining the structural stability of the pelvis during the workout in the prone posture.

<The Implication of the Existence of Feature #3 Described Above>

The pain caused in the pubis with the conventional product can be eased by utilizing this assisting instrument. This function becomes possible together with the effect of the assisting instrument itself being an unstable object because of the existence of the supporting part of the semicircle pillar shape or the like, and the reaction force from the floor surface is distributed.

The following listed efficacies can be acquired by the above features:

1) activation of the core muscles which exist from the pelvis to the abdominal cavity (facilitation of the functional stability of the pelvis);

2) facilitation of the structural stability of the pelvis by urging the nodding movement of the sacrum;

3) activation of muscle groups which exist in the rear side of the person's body, such as the hamstrings, gluteus maximus, and back muscles; and 4) relaxation and stretching of muscle groups, such as buttocks, hips, and back muscles by the twisting movements.

The following workout effects can be expected by improving the physical performance of the above:

1) improvement in the athletic performance of golf, tennis, and baseball which require the twisting movements;

2) improvement in the performance of the fundamental movements of walking and standing;

3) toning from the femurs (thighs) to the buttocks and to the back by stimulating hamstrings of the gluteus maximus, and back muscles, and by relaxation of the hips muscle group; and 4) application to rehabilitation for lower back pains or the like.

(Modification 1)

The upper surface of the rectangular parallelepiped section 1A may only be formed in a flat part, without providing the stepped part 7 of the assisting instrument to the rectangular parallelepiped section 1A, and without providing the third pad 8. In this case, although pain in the pubis part of the pelvis of the person working out is not eased, it is possible to train their abdominal core muscles.

(Modification 2)

Although the first pad 4 of the elastic body is placed on the upper surface 2US of the second body part 2 in Embodiment 1, a cushioning body made of, for example, rubber or urethane may be integrated with the second body part 2 formed from a cushioning body made of the same material (for example, rubber or urethane), instead of providing the first pad 4. In the present invention, the cushioning bodies which replace the first pad 4 of Embodiment 1 and the first pad 4 in this modification are defined together as "the first cushioning part of the elastic body that is integrated with the second body part and forms the second fulcrum of the right anterior superior iliac spine of the ilium of the person working out during the workouts in the prone posture."

Similarly, the second pad 5 of the elastic body is placed on the upper surface 3US of the third body part 3. However, instead of the placement of the second pad 5, a cushioning body made of, for example, rubber or urethane may be integrated with the third body part 3 formed from a cushioning body made of the same material. In the present invention, the cushioning bodies which replace the second pad 5 of Embodiment 1 and the second pad 5 in this modification are defined together as "the second cushioning part of the elastic body that is integrated with the third body part and forms the third fulcrum of the left anterior superior iliac spine of the ilium of the person working out during the workouts in the prone posture."

(Modification 3)

The semicircle pillar section 1B of the first body part 1 of FIG. 1 in Embodiment 1 may be a semispherical section (see FIG. 5 which is a side view) instead. In this case, when working out in the prone posture using the assisting instrument, the apex part 1BT of the part contacts with the floor surface 9 at a point. Even in this case, the semispherical section of the first body part 1 is in an unstable state to the left and the right (in the second directions D2(+) and D2(−)) and, thus, the assisting instrument is provided with the mobility in the rotating directions to the left and the right (unstableness=mobility).

Figure 6:
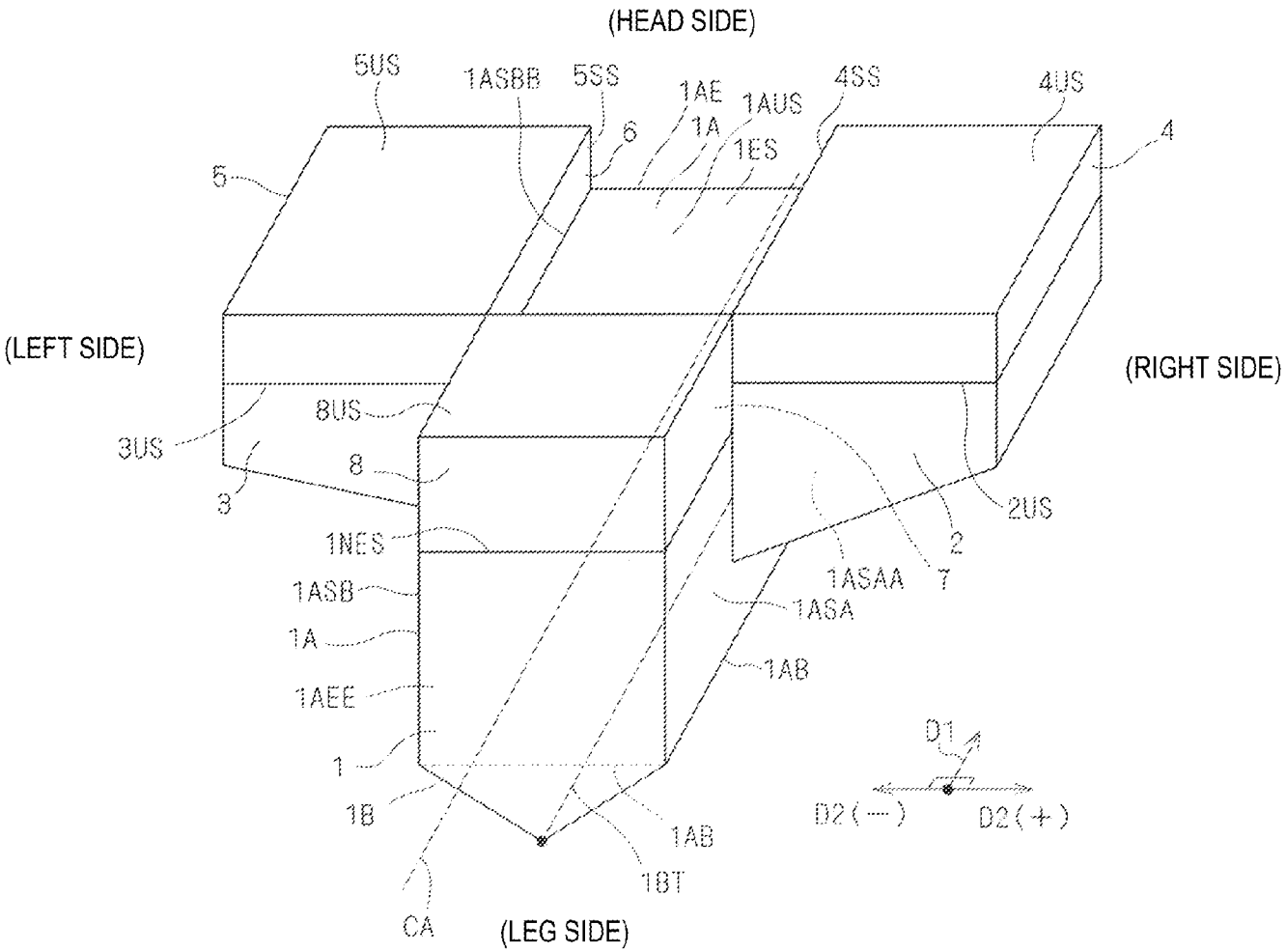
FIG. 6 is a perspective view according to another modification of Embodiment 1 of the invention illustrating a configuration of a prone workout assisting instrument.

Alternatively, the semicircle pillar section 1B of the first body part 1 of FIG. 1 may be replaced by a triangular pyramid part which has a triangular shape in the vertical cross-sectional shape in the first direction D1 (see FIG. 6 which is a perspective view). In this case, when working out in the prone posture, the apex part 1BT of the triangular pyramid part is in a state where it linearly contacts the floor surface 9. Similarly, the triangular pyramid part of the first body part 1 is unstable to the left and the right (in the second directions D2(+) and D2(−)), and the assisting instrument is provided with mobility in the rotating directions to the left and the right (unstableness=mobility). Note that the triangular pyramid part may be referred to as a "triangular prism part."

(Modification 4)

In Embodiment 1, the second directions D2 are directions which are perpendicular to the first direction D1 and pass through the floor surface 9, and the assisting instrument has a T-shaped structure as illustrated in FIG. 4, when the assisting instrument is viewed from above. Instead of this structure, a structure of the assisting instrument in a top view branched into a three pronged fork, typically, the arrangement of the second body part 2 and the third body part 3, i.e., the extension in the second direction and the extension in the third direction (D2(−)) with respect to the first direction D1 may be altered so that the structure has a Y-shape. In this case, the second direction D2 is a direction which intersects with the first direction D1 at an intersecting angle which is other than 90° and which extends along a surface parallel to the floor surface 9. The second body part 2 extends in the second direction. Similarly, the third body part 3 extends symmetrically with the second direction, or extends in the third direction extending along the same surface and in a direction such that the third body part 3 separates from the second body part 2. Effects which may be acquired in this modification are similar to those described in Embodiment 1. In the case of this modification, the assisting instrument has a structure where the supporting part does not exist at the abdomen of the person working out.

The functions and effects described in Embodiment 1 can also be acquired in this modification.

(Modification 5)

Instead of the three-point support described in Embodiment 1, the pelvis and the abdomen may be entirely (totally) supported. In this case, the assisting instrument includes (1) a supporting part for supporting the anterior superior iliac spines and the pubis of the pelvis at three points, and supporting the pelvis and a part around the abdomen, and (2) an unstable part that is integrated with the supporting part and is movable in the rotating directions of the person's body to the left and the right, while being in a state of contact with the floor surface, either a linear contact or a point contact, during the workouts in the prone posture.

(Additional Remarks)

As described above, although the embodiment of the invention is disclosed and described in detail, the above description illustrates aspects to which the present invention is applicable, and the present invention is not limited to the aspects. That is, it is possible to consider various changes and/or modifications to the described aspects without departing from the scope of the present invention.

INDUSTRIAL APPLICABILITY

The present invention is suitable when it is applied to the workout assisting instrument for allowing the workouts in the prone posture with the three-point support at home, a fitness club, or a sports club.

DESCRIPTION OF REFERENCE NUMERALS

1 First Body Part
1A Rectangular Parallelepiped Part
1B Semicircle Pillar Part
1BT Apex Part of Semicircle Pillar Part
1AB Bottom Part of Rectangular Parallelepiped Part
1AE One End Side Part of Rectangular Parallelepiped Part
1ASA One Side Surface Part of Rectangular Parallelepiped Part
1ASB Other Side Surface Part of Rectangular Parallelepiped Part
1AUS Upper Surface of Rectangular Parallelepiped Part
1ES Exposed Part of Upper Surface of Rectangular Parallelepiped Part
1NES Part Other Than Exposed part of Upper Surface of Rectangular Parallelepiped Part
2 Second Body Part
2US Upper Surface of Second Body Part
3 Third Body Part
3US Upper Surface of Third Body Part
4 First Pad of Elastic Body
5 Second Pad of Elastic Body
4SS Side Surface of First Pad Opposing to Second Pad
5SS Side Surface of Second Pad Opposing to First Pad
6 Groove Part
7 Stepped Part
8 Third Pad of Elastic Body (Third Cushioning Part)
D1 First Direction
D2 Second Direction

The invention claimed is:

1. A prone workout assisting instrument, comprising:

a first body part comprising (A) a rectangular parallelepiped part extending in a first direction parallel to a floor surface, including one side surface part extending in the first direction and another side surface part extending in the first direction and opposing the one side surface part, and being a first fulcrum of a pubis of a person during workouts in a prone posture, and (B) a supporting part entirely integrated with a bottom part of the rectangular parallelepiped part in the first direction, and including an apex part that comes to be in a state of linear contact with the floor surface in the first direction when the person works out in the prone posture such that contact between the apex part and the floor surface forms a singular linear contact, the apex part extending along a bottom portion of the first body part;

a second body part projected from a first portion of the one side surface part in a second direction along a surface parallel to the floor surface through which the first direction passes, the first portion corresponding to one end side part of the one side surface part and being between a first part oriented toward a head of the person during the workouts in the prone posture and a second part separated from the first part by a predetermined dimension within the rectangular parallelepiped part;

a third body part projected from a second portion of the other side surface part in a third direction that extends away from the second body part and along the surface parallel to the floor surface, the second portion corresponding to the one end side part of the other side surface part and being between the first part oriented toward the head and the second part separated from the first part;

a first cushioning part of an elastic body integrated with the second body part and being a second fulcrum of a right anterior superior iliac spine of an ilium of the person during the workouts in the prone posture; and a second cushioning part of an elastic body integrated with the third body part and being a third fulcrum of a left anterior superior iliac spine of the ilium of the person during the workouts in the prone posture.

2. A prone workout assisting instrument, comprising:

a first body part comprising (A) a rectangular parallelepiped part extending in a first direction parallel to a floor surface, including one side surface part extending in the first direction and another side surface part extending in the first direction and opposing the one side surface part, and being a first fulcrum of a pubis of a person during workouts in a prone posture, and (B) a supporting part entirely integrated with a bottom part of the rectangular parallelepiped part in the first direction, and including an apex part that comes in a state of linear contact in the first direction with the floor surface when the person works out in the prone posture such that contact between the apex part and the floor surface forms a singular linear contact, the apex part extending along a bottom portion of the first body part;

a second body part projected from a first portion of the one side surface part in a second direction along a surface parallel to the floor surface through which the first direction passes, the first portion corresponding to one end side part of the one side surface part and being between first part oriented toward a head of the person during the workouts in the prone posture and a second part separated from the first part by a predetermined dimension within the rectangular parallelepiped part;

a third body part projected from a second portion of the other side surface part in a third direction that extends away from the second body part and along the surface parallel to the floor surface, the second portion corresponding to the one end side part of the other side surface part and being between the first part oriented toward the head and the second part separated from the first part;

a first cushioning part of an elastic body integrated with the second body part and being a second fulcrum of a right anterior superior iliac spine of an ilium of the person during the workouts in the prone posture; and a second cushioning part of an elastic body integrated with the third body part and being a third fulcrum of a left anterior superior iliac spine of the ilium of the person during the workouts in the prone posture, wherein the rectangular parallelepiped part of the first body part includes a stepped part in an upper surface of the rectangular parallelepiped part, wherein the prone workout assisting instrument further comprises a third cushioning part of an elastic body placed on a part of the upper surface of the rectangular parallelepiped part, relatively lower than the stepped part, the third cushioning part being the first fulcrum during the workouts in the prone posture.

* * * * *